US005243901A

United States Patent [19]

Green

[11] Patent Number: 5,243,901

[45] Date of Patent: Sep. 14, 1993

[54] FIREWOOD BANDING MACHINE

[76] Inventor: Richard Green, P.O. Box 249, Titus, Ala. 36080

[21] Appl. No.: 926,232

[22] Filed: Aug. 6, 1992

[51] Int. Cl.[5] ..... B65B 13/06; B65B 27/10

[52] U.S. Cl. ..... 100/7; 53/390; 53/592; 100/8; 100/25; 100/34; 100/912; 144/192

[58] Field of Search ..... 100/7, 8, 34, 912, 102, 100/25, 1, 2; 144/192; 53/589, 592, 390

[56] References Cited

U.S. PATENT DOCUMENTS

| | | | |
|---|---|---|---|
| 2,364,518 | 12/1944 | Clouser | 100/34 |
| 2,564,442 | 8/1951 | Moore | 100/1 |
| 2,844,091 | 7/1958 | Shafer et al. | 100/25 |
| 2,943,558 | 7/1960 | Hall et al. | 100/2 X |
| 3,182,586 | 5/1965 | Armington et al. | 100/7 |
| 3,556,319 | 1/1971 | Holden | 100/8 X |
| 3,757,678 | 9/1973 | Hemmingsen et al. | 100/7 X |
| 3,939,762 | 2/1976 | Smitherman et al. | 100/4 |
| 3,971,309 | 7/1976 | Brodie | 100/2 |
| 4,072,094 | 2/1978 | Smitherman et al. | 100/3 |
| 4,150,615 | 4/1979 | Russell | 100/7 |
| 4,219,057 | 8/1980 | Falk | 144/192 X |
| 4,269,242 | 5/1981 | Smith et al. | 144/192 |
| 4,377,362 | 3/1983 | Meinke | 100/8 X |
| 4,463,667 | 8/1984 | Jones | 100/8 X |
| 4,467,712 | 8/1984 | Fincham | 100/8 |
| 4,951,562 | 8/1990 | Ribaldo | 100/8 |

FOREIGN PATENT DOCUMENTS

| | | | |
|---|---|---|---|
| 3125928 | 1/1983 | Fed. Rep. of Germany | 53/390 |
| 54-53099 | 4/1979 | Japan | 100/34 |
| 296697 | 4/1971 | U.S.S.R. | 100/2 |
| 361953 | 2/1973 | U.S.S.R. | 100/2 |

*Primary Examiner*—Stephen F. Gerrity

*Attorney, Agent, or Firm*—Willian, Brinks, Olds, Hofer, Gilson & Lione

[57] ABSTRACT

This invention is directed to bundling and banding machine that forms and bands bundles of firewood into the shape of a stable wood pile that can be easily removed from the machine, transported as a banded bundle and when deposited at its final destination and the bands are removed it will stand as a stable wood pile, with a minimum of distortion or need of restacking. The bundle can be of several shapes such as circular, rectangular, square or triangular 28 Claims, 6 Drawing Sheets

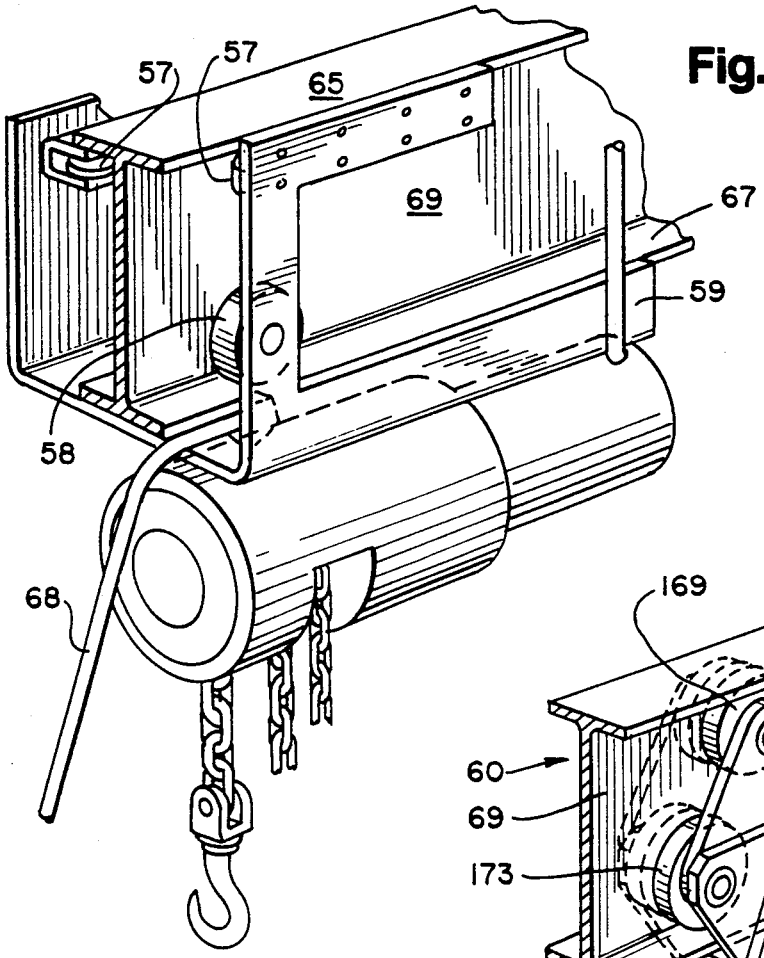
Fig. 3
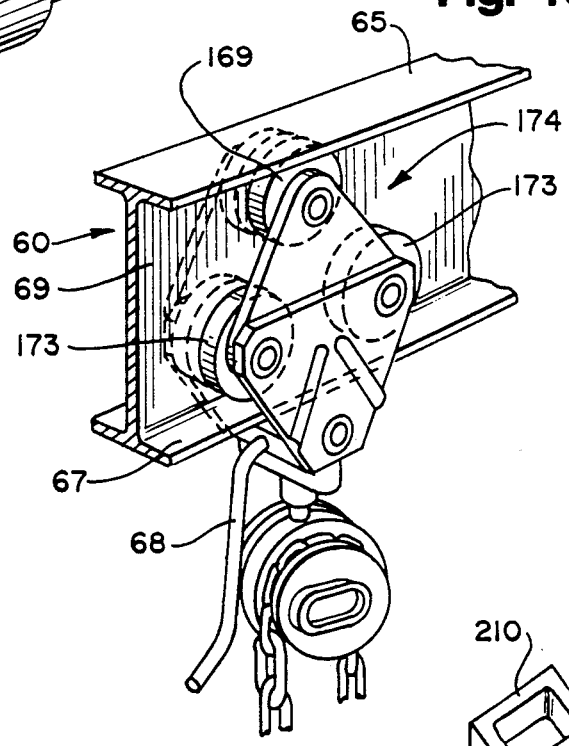
Fig. 10
Fig. 2
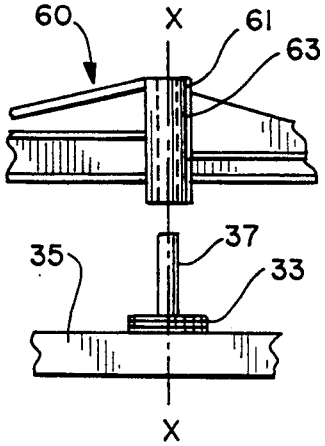
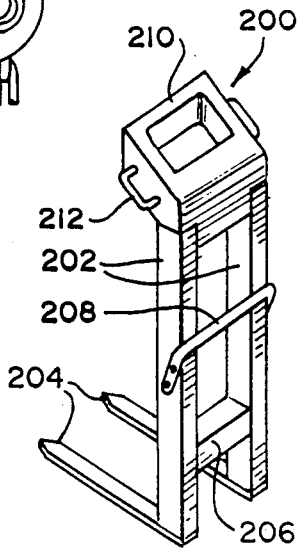
Fig. 11

Fig. 9
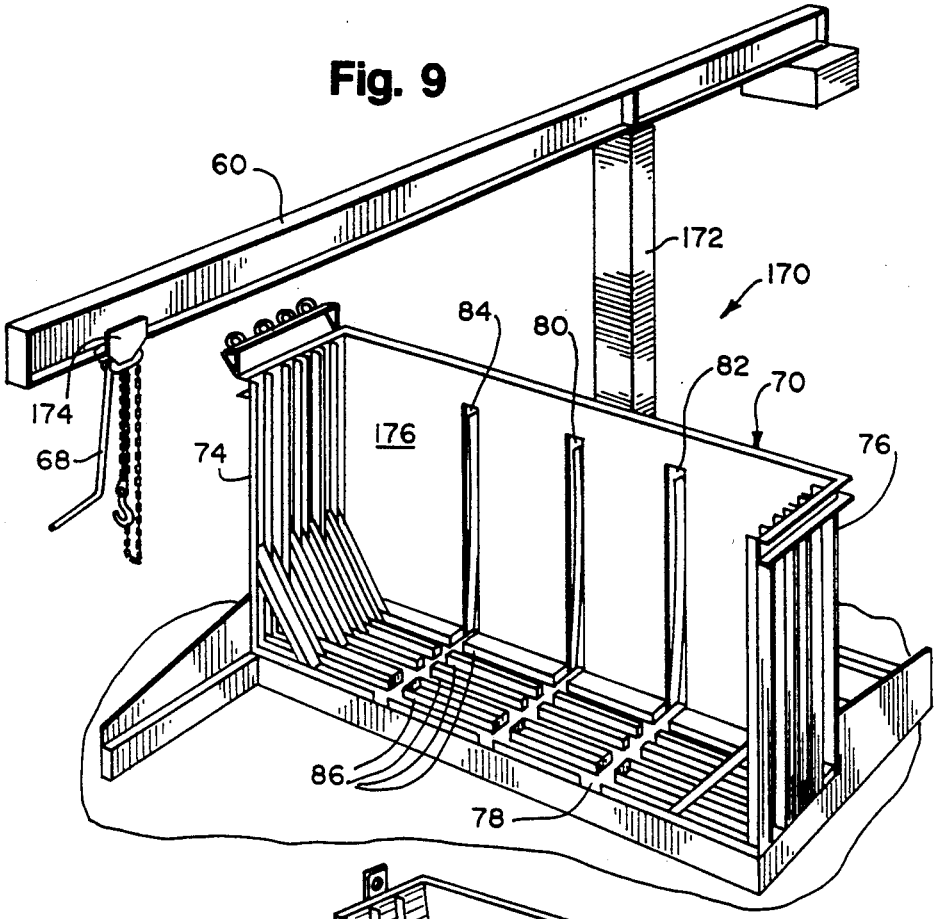
Fig. 12
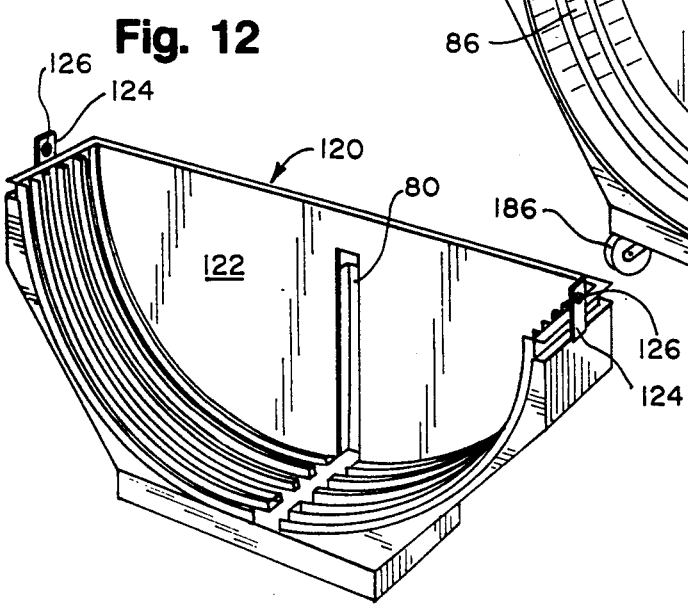
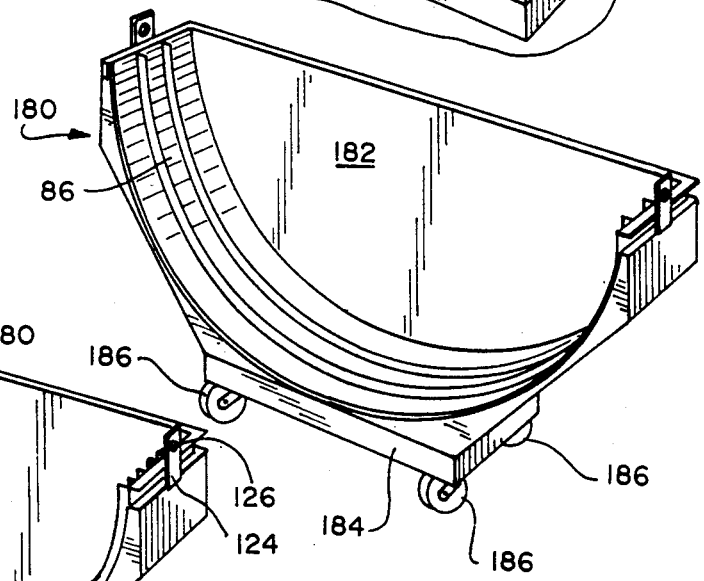
Fig. 13

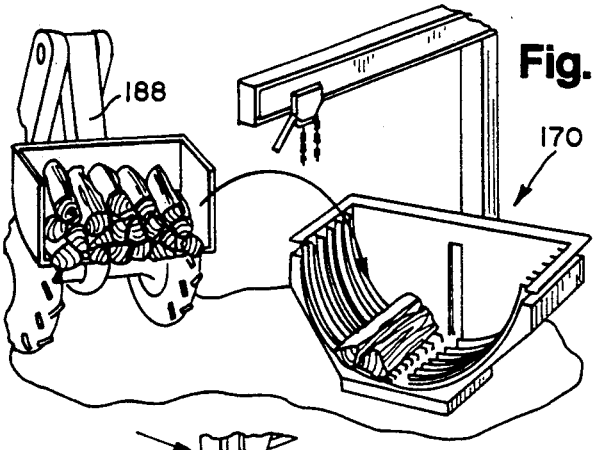
Fig. 14
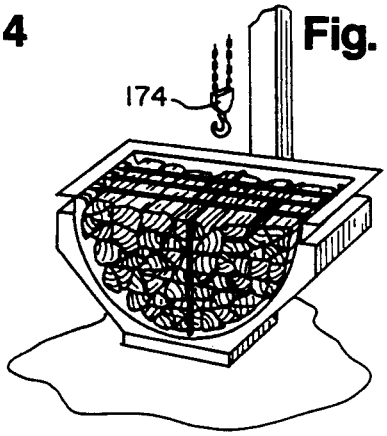
Fig. 15
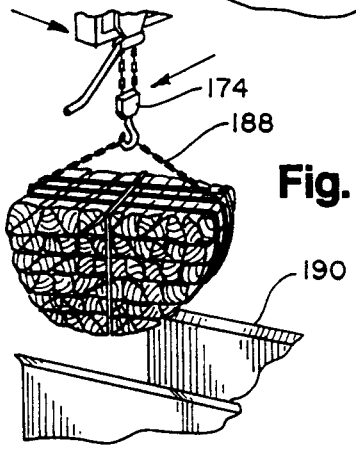
Fig. 16
Fig. 17
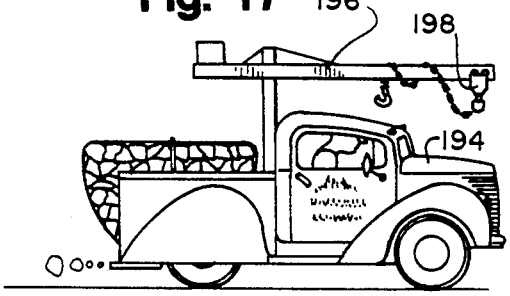
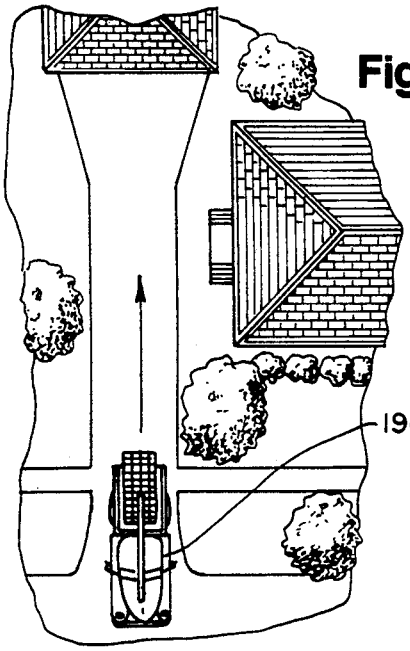
Fig. 18
Fig. 19
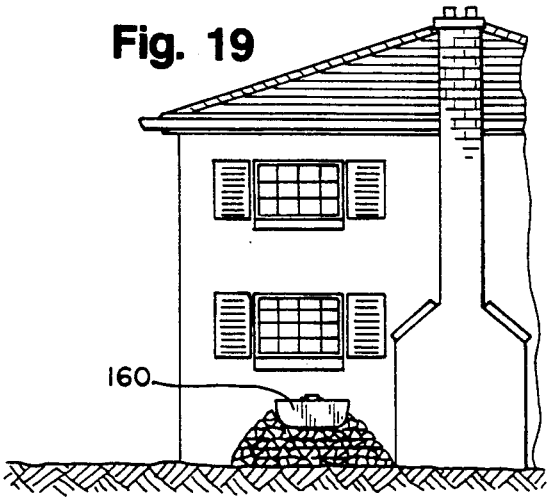

FIREWOOD BANDING MACHINE

BACKGROUND OF THE INVENTION

This invention relates to a method for manufacturing, handling and distributing firewood and to the mechanisms used to practice this method.

Firewood has traditionally been processed by manually stacking the cut and split individual sticks to form a woodpile at the location where it is cut, load the firewood from these woodpiles when it is to be transported from the place where it was cut to the place where it was to be used, manually unload the firewood and restack it. It is common to transport firewood for use in wood-burning fireplaces, as a hand stacked pile in the bed of a pick-up truck, to a selected location where it is manually unloaded from the truck bed and loosely stacked in a wood pile from which it is transported, sometimes piece by piece, to the wood burning fireplace. Such loosely stacked wood piles often prove to be unstable, fall and must be restacked. Manual handling of firewood is difficult because it is heavy and often of a size making it awkward to maneuver. The traditional way of processing and delivering firewood at an affordable price to the consumer has resulted in long delivery times and woods piles that are unstable and dangerous.

Various firewood bundling and banding machines are known which compress small bundles of firewood, apply a band around the compressed bundle and then release the compression means.

Examples of such machines are shown in U.S. Pat. Nos. 3,939,762 and 4,072,094. The machines disclosed in these patents produce a small bundle of firewood having a round cross-sectional shape. These machines contemplate compressing the bundle with mechanical compression means, banding the compressed bundle, releasing the mechanical compression means to form a bundle of firewood that expands into a tightly banded bundle. Such devices have the disadvantage that the expanded tightly banded bundles are difficult if not impossible to remove from the mechanical compression means and the round cross-sectional shape are not, when the banding is cut in the shape of a stable wood pile. Another machine for producing banded bundles of firewood having a round cross-sectional shape is shown in U.S. Pat. No. 4,377,362. The round shaped bundle is not convenient for handling and transporting and will not be retained as a stable stacked wood pile when the banding is released.

A wood baling machine is disclosed in U.S. Pat. No. 4,467,712 which produces a banded bundle of firewood having a square cross-section shape. The firewood is bundled on a pallet that is surrounded by a mold, mechanically compressed and then banded (including the pallet) after which two sides of the mold can be moved away from the bundle to release the banded bundle from the mold. After the sides of the mold are moved away from the bundle the mold remains closed at the top and the bundle must be lifted from below by the tines of a fork lift and then backed out of the mold. The square cross-section shape of the bundle, as a result of the bands extending in only one direction, does not have the integrity to retain its shape and will collapses into the unstable shape of a rhombus.

U.S. Pat. No. 4,463,667 discloses a log bundling apparatus for collecting and tying floating logs into bundles and U.S. Pat. No. 4,951,562 discloses a strapping machine for compressing a compressible load and then strapping the load into a bundle.

Although some of the above machines may be generally satisfactory for producing small bundles of firewood, they do not meet the need that this invention is intended to satisfy. It is the objective of this invention to provide a machine that can bundle and band large bundles of firewood that can be transported from the bundling cite to intermediate cites and finally to the ultimate customer where it is deposited in the form of a stable stack of wood, all without manually handling after the initial bundle is formed.

It is a further objective of this invention to provide a firewood bundling and banding mechanisms that can be used to establish a fully integrated fire wood marketing enterprise.

It is also an objective of this invention to provide the basic tools necessary to establish a firewood bundle retailing establishment.

It is a still further objective of this invention to provide the basic tools to establish an economically feasible firewood bundling and banding manufacturing process that will facilitate delivery of the banded firewood bundles to the consumer.

It is a still further objective of this invention to produce stable and safe banded bundles of firewood that can be manipulated for transporting and deposited at the consumers facility in a stable and safe configuration.

SUMMARY OF THE INVENTION

To achieve these and other objectives, the present invention provides a bundling and banding machine that forms and bands bundles of firewood into the shape of a stable wood pile that can be easily removed from the machine, deposited on the ground as a stable wood pile, picked up and transported numerous times and when deposited at its final destination and the bands are released will stand as a stable wood pile. When the bands are released occasionally a few of the many fire wood sticks will require restacking.

A preferred embodiment of the invention includes an open top mold for forming the bundle, banding mechanism for applying longitudinal and transverse bands around the bundle and a boom arm having a moving hoist trolley that can overlay the banded bundle of firewood, pick it up and relocate it, for temporary storage or immediate delivery from the manufacturing site to the consumer.

An advantage of the present invention is that the banded bundle can be easily removed and relocated from the open top mold by the over lying hoist trolley.

Another advantage of the present invention is that it can be produced as either a manually operated or as a powered machine.

Still another advantage of the present invention is that the banding on the finished bundles can be tightened outside of the machine to accommodate for shrinkage of green wood.

Yet another advantage of the present invention is that regardless of whether the machine is of the manual or powered type it can be operated by a single operator.

These and other objects and advantages of the present invention will no doubt become apparent to those skilled in the art after having read the following detailed description of the preferred embodiment which are contained in and illustrated by the various drawing figures.

BRIEF DESCRIPTION OF DRAWING

FIG. 2 is an exploded view of the pivot mechanism for the overhead boom arm.

FIG. 3 is a perspective view of one embodiment of the electric hoist trolley.

FIG. 9 is a perspective view of another embodiment of a manual bundling and banding machine.

FIG. 10 is a perspective view of one embodiment of a manual hoist trolley for use with the machine shown in FIG. 9.

FIG. 11 is a perspective view of a heel lifting tool for use with the machine shown in FIG. 9.

FIG. 12 is a perspective view of an implement that can be used with the bundling and banding machines show in FIGS. 1 and 9.

FIG. 13 is a perspective view of a skiff bucket that can be used with the bundling and banding machines shown in FIGS. 1 and 9.

FIG. 14 is a pictorial view of a bundling and banding machine being filled with firewood.

FIG. 15 is a pictorial view of the completed banded bundle in the machine.

FIG. 16 is a pictorial view of the banded bundle being loaded into a truck bed.

FIG. 17 is a pictorial view of the loaded truck delivering the banded bundle to a customer.

FIG. 18 is a plan view of the loaded truck at the customers home.

FIG. 19 is a pictorial view of the banded bundle after it has been deposited at the customers home.

DETAILED DESCRIPTION OF THE PREFERRED EMBODIMENT

Figure 1:
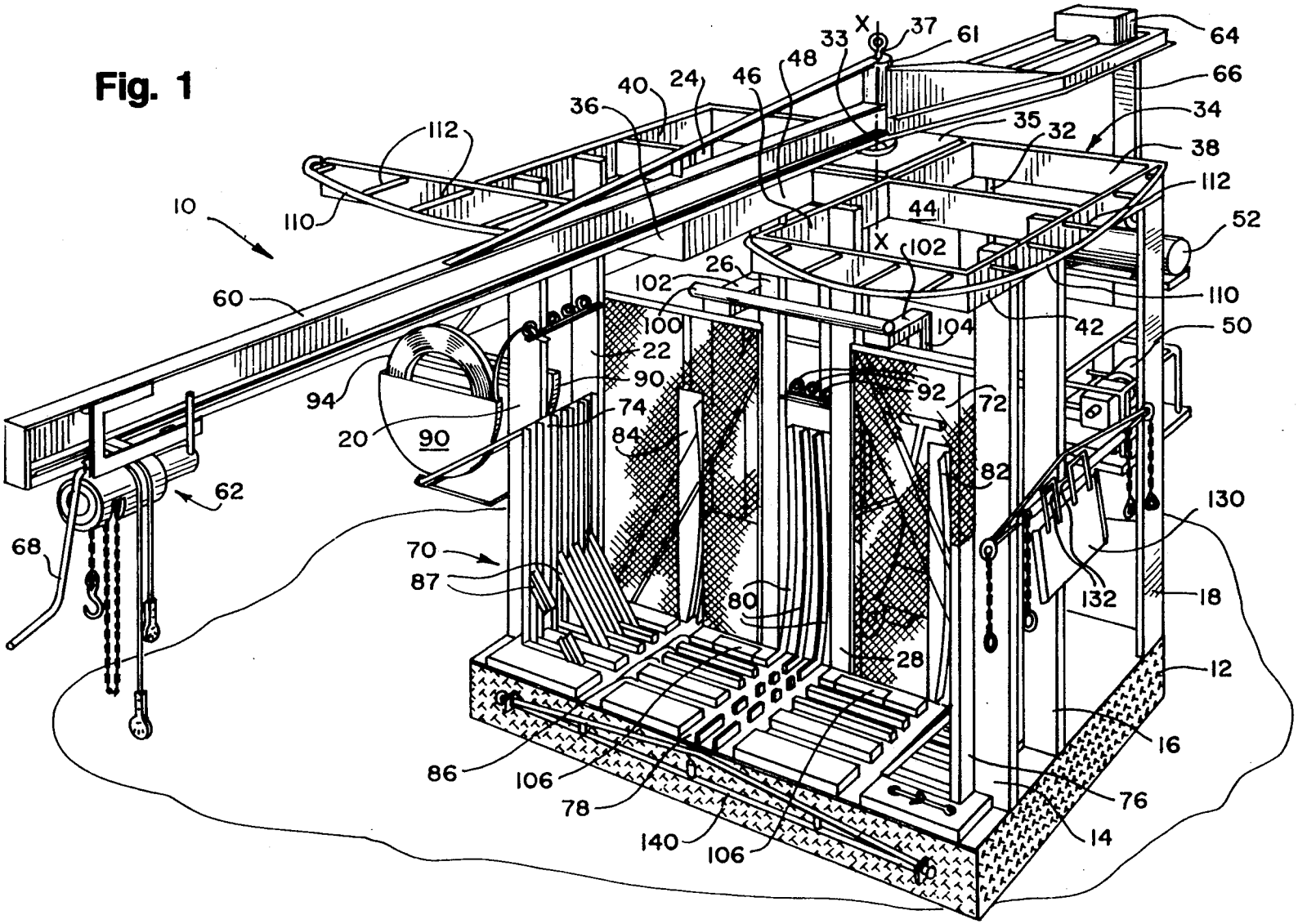
FIG. 1 is a perspective view of one embodiment of the bundling and banding machine.

Referring now to FIG. 1, there is shown a perspective view of a preferred embodiment of the bundling and banding machine 10. The bundling and banding machine 10 has a base section 12 upon which the upright frame members 14, 16, 18, 20, 22, 24, 26, 28, 30 and 32 are secured at their bottom ends. The top ends of upright frame members 14 through 32 are secured to a top frame section generally designated 34. Top frame section 34 is formed of front frame members 36, back frame member 38, end frame members 40 and 42 and cross frame members 44, 46 and 48.

An overhead boom 60 is pivotally mounted on the top frame section 34 of the bundling and banding machine 10. The mounting mechanism for overhead boom 60 is shown in the exploded view of FIG. 2. The overhead boom 60 includes a housing collar 61 that has a vertical bore 63 extending therethrough. The top frame section 34 has a horizontal top plate 35 from which a vertical pivot shaft 37 extends. Several greased shims 33 are placed over vertical pivot shaft 37 such that they are supported on the horizontal top plate 35. The overhead boom 60 is mounted on the top frame .section 34 by aligning vertical pivot shaft 37 with the vertical bore 63 and lowering the overhead boom 60 such that the bottom horizontal surface of the housing collar rest on the upper surface of the stack of shims 33. A loose fit between vertical pivot shaft 37 and vertical bore 63 is provided for example the bore 63 could have a diameter of 3 inches and the pivot shaft 37 a diameter of $2\frac{7}{8}$ inches. The concept of the overhead boom mounting is that the boom extends in both directions from its pivot axis X—X and is counter-weighted on its tail end so that it will float on the greased shims. The pivot shaft 37 functions as a guide rather than a load bearing pivot pin. An electric hoist trolley 62 is carried by the forward extending portion of the boom 60 and a counterweight 64 is carried by the rearward extending portion. The electric hoist trolley 62 is sometimes used to deposit loads of fire wood into the mold 70 and to lift the completed banded bundle out of the mold 70 and move it away from the bundling and banding machine 10. A handle 68 is attached to the trolley portion of the boom 60 that can be grasp by the operator and used to move the overhead boom 60 about its pivot axis X—X.

Referring now to FIG. 3 wherein a detailed view of one embodiment of the electric hoist trolley is shown. The overhead boom 60 has an upper rail 65, a lower rail 67 and a flange 69. The carriage 59 of the electric hoist trolley 62 has at least two wheels 58, mounted for rotation thereon, on each side of the flange 69, that rest on the upper surface of lower rail 67. The electric hoist trolley 62 as well as a load such as a bail of wood can be easily moved longitudinally along the overhead boom as a result of the wheels 58 rolling along the upper surface of the lower rail 67. An electric garage door opener has been attached to the carriage 59 (not illustrated) which causes the electric hoist trolley 62 to move in either direction along the overhead boom 60 and to automatically stop at the ends of the boom. The carriage 59 extends upwardly and has a plurality of wheels 57 mounted for rotation at its upper portion. The wheels disclosed in this figure rotate about vertical axes and engage the upright flange 69. The purpose of these wheels is to stabilize the electric hoist trolley on the overhead boom. It should be noted that the upper stabilizing wheels could also be mounted such that they rotate about horizontal axes and engage the lower surface of the upper rail 65. Such an arrangement is illustrated in FIG. 10 which shows a manually operated hoist trolley. A preferred embodiment of the electric hoist trolley has a total of 10 wheels that function to stabilize the trolley.

A handle 68 is secured to the carriage 59 and extends down to a level where it can be conveniently grasp by the operator. The overhead boom 60 can be conveniently swung about pivot shaft 37 by an operator using the handle. The upper wheels 57, in engagement with the flange 69 during such a swinging operation, maintain the carriage 59 in an upright position. The handle 68 provides a much improved means for pivoting the overhead boom 60 and sliding the electric hoist trolley 62 along the overhead boom than pulling and pushing on the chains or on the load carried by the hoist trolley.

The bundling and banding machine 10 is self contained such that the entire machine can be picked up by a crane, forklift or the like and moved from one location to another. In the embodiment shown in FIG. 1, the bundling and banding machine 10 includes its own power generator 50 which may include a power source such as an internal combustion engine. The power generator 50 can generate electrical power as well as drive an air compressor 52 so that pneumatic power is available. It should be noted that there is a vertical support 66 secured to and extending downwardly from the rearmost end of overhead boom 60 upon which the power generator 50 and air compressor 52 are mounted such that they serve the additional function of counterweights for the forwardly extending portion of the overhead boom 60.

The bundling and banding machine 10 includes a bundle mold or cavity section designated 70. The mold or cavity section 70 is defined by a vertical back wall 72, end walls 74 and 76 and a bottom 78. The vertical back wall 72 can be made of expanded metal or screen type material which provides for visibility through this member. Three central transverse chase ways 80 and intermediate chase ways 82 and 84 extend vertically along back wall 72. The chase ways 80, 82 and 84 continue across the bottom 78 of the mold or cavity section 70. Four perimeter or longitudinal chase ways 86 are formed in the end walls 74 and 76 and extend across the bottom 78. The perimeter chase ways 86 include diagonal sections 87 that extend at 45 degree angles to both the end walls 74 and 76 and the bottom 78. The back wall chase ways 80, 82 and 84 cross the end wall chase ways 86 in the bottom 78. The chase ways 80, 82, 84, and 86 are formed from channel iron and provide tunnel ways through which banding material or chains can be threaded after the bundle or fire wood has been packed into the mold section 70. There are band holding magazines 90 and eyelets 92 corresponding to each chase way. A roll of banding material 94 is stored in each of the magazines 90 with a free end extending through the eyelet 92.

A heel lift rod 100 extends horizontal over the mold section 70 at a level above the banded bundle, such that it can be grasp and lifted by the hook of electric hoist trolley 62. The heel lift rod 100 is secured to the free ends 102 of lift members 104. Lift members 104 have vertically extending portions that are located behind the vertical back wall 72. Heel members 106 are connected to the lower ends of lift members 104. The purpose for and operation of the heel lift mechanism will be discussed in greater detail with reference to FIGS. 4 and 5.

Railings 110 are secured to and spaced from the top frame section 34 by horizontal rods 112. If the electric hoist trolley 62 is moved inwardly toward the pivot of overhead boom 60 when overhead boom 60 is located such that it overlays a piece of the railings 110, the electric hoist trolley will strike the railings and thus prevent the hoist trolley 62 from banging into the bundling and banning machine 10. This feature of the invention also protects a person from being pinned between a bundle of fire wood carried by the electric hoist trolley 62 and the bundling and banning machine 10.

Figure 7:
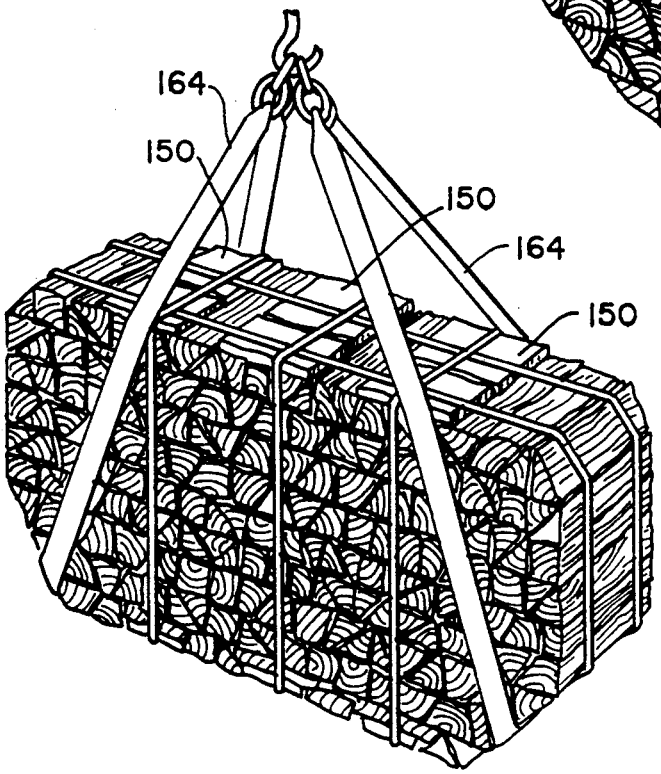
FIG. 7 is a perspective view of the rectangular banded bundle being lifted by nylon straps.

The bundling and banding machine 10 illustrated in FIG. 1 is constructed to produce a specific shaped bundle of fire wood. The bundle produced in this machine is show in FIG. 7 and is refereed to as a rectangular bundle. Although the bundle illustrated in FIG. 7 is refereed to as rectangular, since its lower corners are beveled at 45 degree angles it is not a true rectangular shape. The bundling and banding machine 10 illustrated in FIG. 1 is dimensioned such that it can receive fire wood sticks from 12 inch lengths to 36 inch lengths and band the fire wood sticks into circular, rectangular, triangular or square shaped bundles. The fire wood sticks are stacked into the mold section 70 with one end against the back wall 72. When beginning to fill the mold 70 for a new bundle, fire wood sticks are laid longitudinally of the bundle such that they bridge the transverse chase ways 80, 82 and 84. The purpose for these longitudinally extending fire wood sticks will be discussed in greater detail in the section of the specification covering the design of the bundles.

Figure 6:
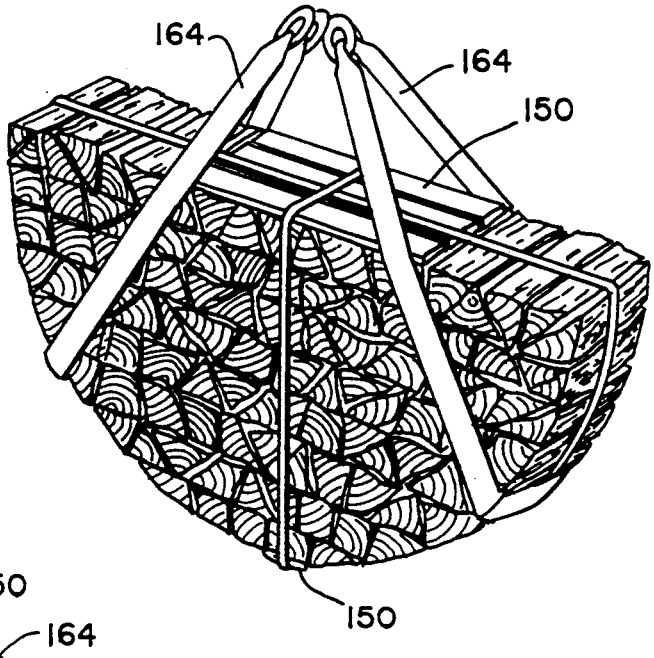
FIG. 6 is a perspective view of the cycloidal banded bundle being lifted by nylon straps.

The bundling and banding machine 10 illustrated in FIG. 1 can also be used to produce bundles of other shapes, for example the cycloidal shaped bundle shown in FIG. 6. The cycloidal shape bundle is produced by securing the implement 120, illustrated in FIG. 12, into the mold section 70. It should be noted that with the implement 120 secured in place all four of the perimeter or longitudinal chase ways 86 are utilized but only one of the central transverse chase way 80 need be used. Additional implements for producing bundles of other shapes, for example triangular and square shaped bundle can presently be produced. However the triangular shaped bundles are more difficult to transport, as a group of bundles, because they cannot be stacked on top of each other.

There are several tools, stored for easy access, that are used in the fire wood bundling and banding process illustrated in FIG. 1. A jacking plate 130, having handles 132, is placed on the upper surface of a bundle of fire wood sticks to provide a flat work surface for the banding tool. The jacking plates also prevent damage to the banding material, and facilitates removal of the banding tool. With the jacking plate 130 in place a banding tool is used to tighten the band around the bundle, a keeper or seal is fitted around the overlapped ends of the band and the keeper or seal is crimped to secure the ends of the bands together. When the bands have been secured the handles 132 are used to pull the jacking plate out from between the bundle and the tightly secured bands. The jacking plate illustrated in this figure, has an edge that is slightly turned down to prevent damage to the metal bands, and is used for applying the transverse bands. A second jacking plate differing only in that it is longer is used to apply the longitudinal bands.

The elongated tool 140 is connected to implements such as the cycloidal implement 120 so that the implement can be picked up by the overhead hoist trolley 62 and moved into and out of the mold section 70.

Figure 4:
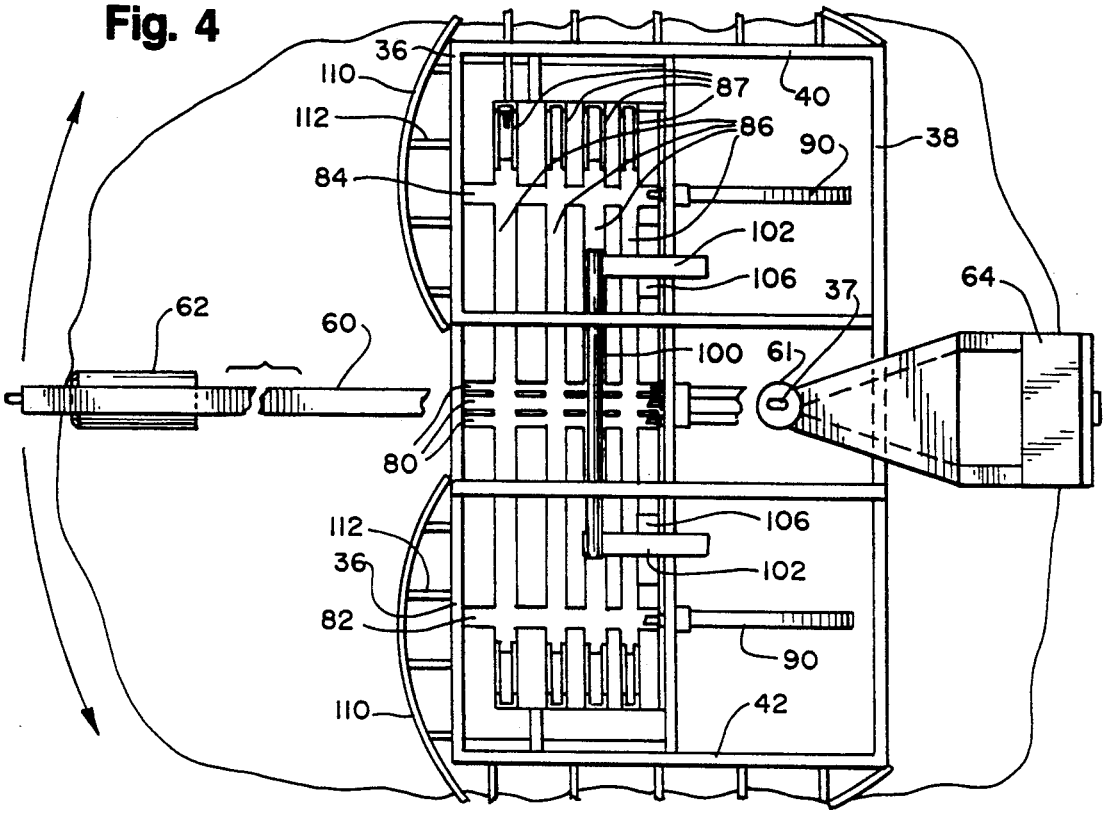
FIG. 4 is a plan view of the bundling and banding machine shown in FIG. 1.
Figure 5:
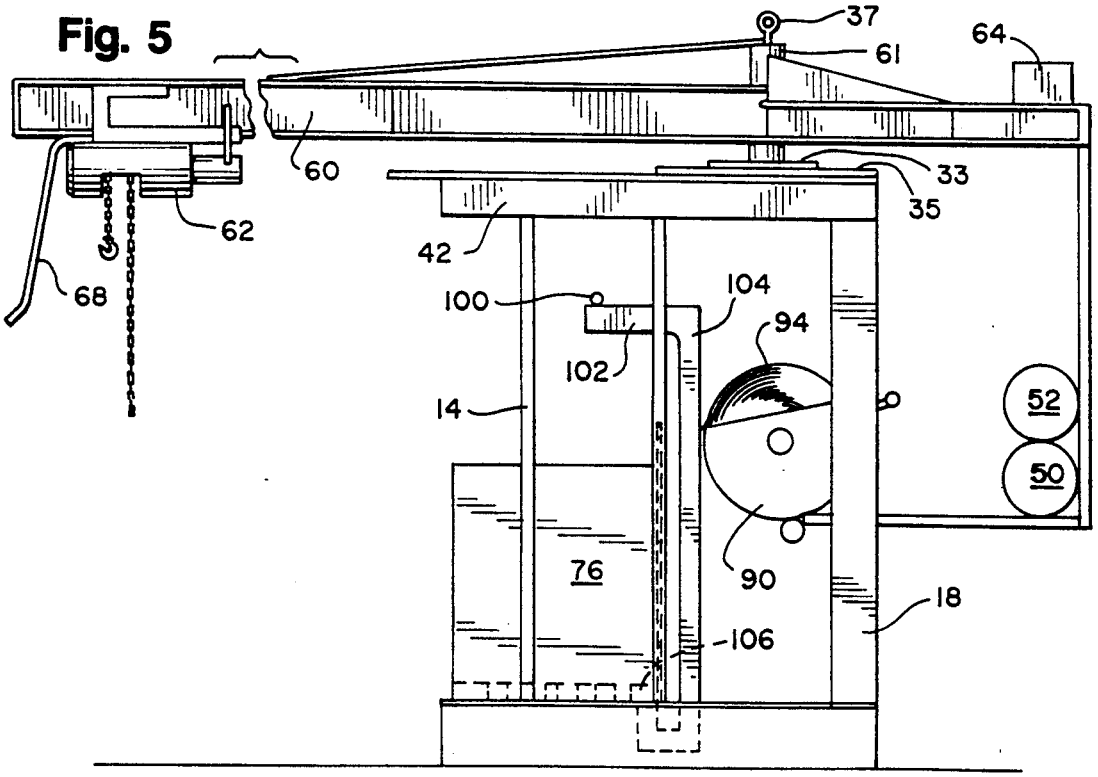
FIG. 5 is a side view of the bundling and banding machine shown in FIG. 1

Referring now to FIGS. 4 and 5 the heel lift feature will be described. Although, the banded bundles can be picked up and moved by the metal bands, it is desirable to lift and move the completed banded bundles by nylon straps 164. As will be further discussed in the section of the specification relating to the shape of the bundles, picking up the completed bundles with straps that are positioned according to this invention enhances rather than detracts from the structure of the banded bundle. This of course contributes to the reliability and safety of the banding and processing system. In addition nylon strapping is less likely to tear or rupture then metal banding material. FIGS. 6 and 7 disclose banded bundles having nylon strapping 164 in place to lift the bundles.

In the bundling and banding machine 10 illustrated in FIG. 1, a horizontal heel lift rod 100 and some of its operating mechanism was discussed. This mechanism is shown in more detail in FIGS. 4 and 5. Located along the bottom back edge of the mold cavity section 70 are a pair of heel members 106. These heel members 106 can be raised vertically and when so raised they will cause the banded bundle to be tilted toward the front of the machine about its front lower edge. The heel members 106 only lift the rear edge of the banded bundle about 3 inches and thus the banded bundle will not fall out of the mold 70. This slight elevation does however provide sufficient clearance between the lower diagonal corners of the banded bundle and the diagonal chase sections 87 to pass the nylon straps 164 through and locate the loop portions of the nylon straps 164 across the diagonal corners of the banded bundle. A strap is extended across both diagonal corner in basket lift configuration and the ends of the nylon straps 164, which can be fitted with fast couplers, are grasp by the hook of the electric hoist trolley. A strapping harness such as this using one inch wide, two-ply nylon straps has the capacity to lift almost four times the maximum weight of the banded bundles made by the machine disclosed in FIG. 1.

A pair of lift members 104 extend vertically behind the vertical back wall 72 of the mold 70 and terminate in upper horizontally extending free ends 102. The heel lift rod 100 is secured by welding of the like to the free ends 102. The lower ends of lift members 104 extend forwardly and then upwardly and are connected to the heel members 106 The vertical portions of lift members 104 are constrained such that they can only move in the vertical direction. As can be seen in FIGS. 4 and 5 the electric hoist trolley 62 is moved inwardly along the overhead boom to a point where the chain can be connected to heel lift rod 100. When the electric hoist trolley is energized to lift heel lift rod 100 the banded bundle is tilted to thus enable the nylon straps 164 to be wrapped around the banded bundle.

Referring now to FIGS. 6 and 7 the design logic of the bundle shape and banding process will be discussed. Prior to filling the mold 70 with the fire wood sticks extending transverse to the bundle, boards 150, are placed in the bottom of the mold such that they cross the transverse chase ways 80, 82 and 84. The boards 150 extend in the longitudinal dimension of the bundle. The mold is then filled with the fire wood sticks that extend transverse to the longitudinal dimensions of the bundle. When the mold 70 is full of fire wood sticks another layer of longitudinal boards 150, extending in the longitudinal direction of the bundle, are placed on the top surface of the bundle.

To band the rectangular bundle, of FIG. 7, the banding material, which is stored in the band holding magazines 90, is pulled through the eyelets 92 and strung down through the transverse chase ways 80, 82 and 84. When the free ends of the banding material emerges from the chase ways at the bottom front edge of the bundle it is pulled through sufficiently to extend up the side of the bundle and across its upper surface. When banding the cycloid shaped bundle, of FIG. 6, a single transverse band can be applied through the central transverse chase ways 80. For either shaped bundle a conventional, manual or powered, banding tool can be used to tighten the band around the bundle. Likewise, either manual or automatic tools can be used to secure the free ends by crimping. The jacking plate 130 is used in combination with the banding tool to insure properly applied bands. The tightly applied transverse bands create forces on the top and bottom of the bundle in directions toward each other and thus create a stable column of wood extending from the top of the bundle to the bottom. In the rectangular shaped bundle three such stable columns are created. The boards 150 on the top and bottom surfaces of the bundle spread the vertical force over a substantial area so that the columns have a corresponding substantial cross section.

Next the perimeter band or bands are applied to the bundle. The mold 70, as seen in FIG. 1 has four perimeter or longitudinal chase ways 86. The appropriate chase way or ways 86 is selected dependent upon the length of the fire woods sticks that are being bundled. The longitudinal or perimeter bands are tightened through the combined use of the banding tool and the jacking plate 130. The longitudinal bands create a force on the fire wood sticks at the ends of the bundle in the direction toward the vertical column of wood. In the cycloidal shaped bundle, of FIG. 6, the longitudinal band creates two cantilever bundles of wood on either side of the vertical wood column. In the rectangular shaped bundle, of FIG. 7, cantilevered bundles of wood are formed at each end of the bundle and the fire wood sticks between the vertical columns of wood are clamped between the vertical columns.

The diagonal edges at the bottom of the rectangular shaped bundle, formed by the diagonal sections 87 of the mold 70, contribute significantly to the formation of the stable cantilevered bundles of wood. The stability of a rectangular shaped bundle that has these diagonal corners is greatly improved over a similarly shaped rectangular bundle with square bottom corners. The voids at the bottom corners of the bundle permit the wood above the void to be pulled down by gravity which creates a tightening force on the perimeter or longitudinal bands.

The rectangular shaped bundle shown in FIG. 7 has sufficient stability that it can be sat on a brick, located at its center, and its ends will be maintained off the ground and the bundle will not collapse. A bundle such as this can be stored indefinitely and retain its stability.

If the wood was green when it was banded and has since shrunk, the stability of the bundle can be reestablished by tightening the longitudinal straps. Tightening of the transverse straps is not necessary because the shrinkage will have been limited to the perimeter of the fire wood sticks and they will not have shrunk a noticeable amount in their length. Thus the only bands that need be tightened are the perimeter bands.

Figure 8:
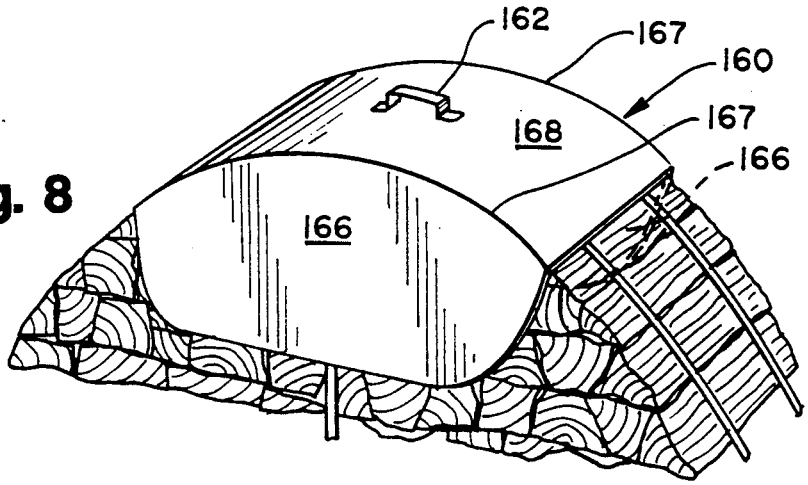
FIG. 8 is a perspective view of the cycloidal banded bundle resting on its flat surface with the shroud in place to sever the bands.

The shape of the bundle illustrated in FIG. 6 is cycloidal. A cycloid is the curve traced by a point on the circumference of a circle that rolls on a straight line. As a result the cycloidal bundle has a length that is greater than twice its height. The cycloidal bundle is maintained in its FIG. 6 posture, which keeps it tight, until it is delivered to the ultimate customer. As is shown in FIG. 8 this bundle is inverted, such that the flat upper surface sits on the ground, when it is delivered to the ultimate customer. With the cycloidal shaped bundle so located, when the bands are cut the bundle retains its shape. Thus when the bundle is delivered to the ultimate customer it is not necessary for any restacking to be done. It has been found that a constant radius semicircular shaped bundle will collapse while the cycloidal bundle does not.

As seen in FIG. 8 a shroud 160, made from aluminum and having a handle 162, is provided to fit over the top of the cycloidal shaped bundle. The shroud 160 has parallel side plates 166, that extend parallel to the front and back surfaces of the bundle, that have an arcuate upper edge 167 and an arcuate top 168 secured to the side plates 166 along the arcuate upper edges 167. The banding material 194 is under considerable tension as a result of being tightened down by the banding tool and jacking plate 130 and can snap back when severed. The shroud 160, is grasp by handle 162 and placed over the bundle after it has been delivered to the ultimate customer. With the shroud 160 in place, as depicted in FIG. 8, the operator reaches beneath the shroud with a cutting device and snips the banding material 94. The shroud 160 will keep the banding material from snapping back and may reduce exposing the operator to injury. It should be noted that although the shroud 160 shown in FIG. 8 has an arcuate shape corresponding to the shape of the cycloidal shaped bundle it can also be use on a rectangular shaped bundle such as the bundle shown in FIG. 7.

As previously stated handling and transporting of the bundles is best accomplished by the use of nylon straps 164 that have been cradled around the bundle. Nylon strapping 164 that is cradled around the bundles, as illustrated in FIGS. 6 and 7, permits the bundles to be picked up out of the molds, deposited for storage, and then relocated as often as necessary without adversely effecting the stability of the bundles.

Referring now to FIG. 9 wherein a second embodiment of bundling and banding machine 170 is disclosed. The machine 170, of FIG. 9, is a stripped down or simplified version of the machine 10 shown in FIG. 1. The machine 170 is a manually operated machine, having no self contained power source or power driven tools. The machine 170 can however accomplish the same results as that accomplished by machine 10 of FIG. 1. It will of course take an operator longer to produce a banded bundle with machine 170 then with machine 10 of FIG. 1. Also the operator would become fatigued sooner when working with machine 170 than with machine 10. Machine 170 has the advantage, because it is lighter, of being easier to transport. Machine 170 can be transported to a site where logs for producing fire wood sticks are available and the logs can be cut, split, bundled and banned at the site.

The bundling and banding machine 170 of FIG. 9 has an overhead boom 60 pivotally mounted on the upper end of a pillar 172. A manually operated hoist trolley 174, having a handle 68 travels along the length of the overhead boom 60.

A detailed view of the manually operated hoist trolley 174 is shown in FIG. 10. The overhead boom 60 has a lower rail 67, and upper rail 65 and a vertical interconnecting flange 69. The manually operated hoist trolley 174 includes a carriage 175 that has a plurality of wheels or rollers 173 mounted for rotation about horizontal axes thereon that support the hoist trolley 174 on the lower flange 67 of the overhead boom 60. It should be noted that the embodiment shown in FIG. 10 has two wheels 173 on each side of upright flange 69, however three or more wheels could be provided.

The mold 70 has a solid rear wall 176 and three transverse chase ways 80, 82 and 84. The side walls 74 and 76 have four perimeter or longitudinal chase ways 86 formed therein that extend across the bottom 78 of the mold 70.

Referring now to FIG. 11 which shows a heel lifting tool 200 for the bundling and banding machine 170. The tool 200 includes a pair of upright post 202 interconnected by a lower support 206 and an upper support 210. A pair of flat tines 204 are secured to the lower ends of the upright post 202 and extend parallel therefrom. A handle 208 interconnects the pair of upright post 202 and a pair of handles 2111 are provided on the outer edges of upper support 210. The flat tines 204 are spaced from each other a distance equal to the distance between the chase ways 80, 82 and 84. When a banded bail has been completed in bundling and banding machine 170 the flat tines 204 of the heel lifting tool 200 are inserted into two of the chase ways 80, 82 and 84. The handles 208 and 212 are then used to tilt the tool 200 along with the banded bundle sufficient to insert the nylon straps 164 under the corners of the banded bundle.

FIG. 12 shows the implement 120 that can be placed in mold area 70 of either machine 10 of FIG. 1 or machine 170 of FIG. 9. The implement 120 has a solid rear wall 122 with a single transverse chase way 80. The side walls 74 and 76 have four perimeter or longitudinal chase ways 86 formed therein. There is a tab 124, having a circular aperture 126 formed therein, extending upwardly from the upper edges of side walls 74 and 76. The implement 120 can be picked up by securing the chain of an overhead boom to apertures 126 or by using a special tool 140 designed for this purpose. The ends of elongated tool 140, seen stored on the base section 12 of machine 10 in FIG. 1, are inserted through apertures 126 and the chain from an overhead boom is secured to the center of the elongated tool 140. A heel lifting tool, similar to tool 200 shown in FIG. 11, having a single tine is used in combination with this machine to insert the nylon straps 164.

There is shown in FIG. 13 a skiff bucket 180, that has a shape corresponding to the shape of implement 120. However the rear wall 182 of the skiff bucket 180 has only one usable chase way formed therein and the arcuate sheet that functions as the side walls and bottom has only one usable chase way 86 formed therein. The base section 184 of the skiff bucket 180 is provided with wheels 186. The wheels 186 allow the loaded skiff bucket 180 to be easily maneuvered around a concrete or other hard surfaced work area used for producing banded bundles. The skiff bucket can be used to gather the cut and split fire wood sticks and transport them to the bundling and banding machine when special sizes or shapes are needed. When an operator desires to transfer fire wood sticks from the skiff bucked to the mold 70 or the implement 120, a chain is threaded through the chase way 86 of the skiff bucket thus wrapping the chain around the entire bundle of fire wood sticks that were collected so that they can be transferred as a unit into the mold 70 or implement 120. Thus even when the fire wood sticks are remote from the bundling and banding machine the manual handling of fire wood sticks is minimized. Another use for the skiff bucket 180 is to store loose pieces of firewood that are of a shape and size to be used to level off the top of a bundle, or to store loose firewood of a size and shape that is not used on a regular basis.

Referring now to FIGS. 14 through 19 which is a sequence of views demonstrating how the bundling and banding machine is used to produce a banded bundle, pick up the bundle and deliver the bundle to the ultimate customer. In FIG. 14 the bundling and banding machine 170 is shown in the process of being filled with fire wood sticks that have been carried to it by a front end loader 188 or other such device. It is of course understood that the fire wood sticks could have been transported to the bundling and banding machine in other ways, such as by a skiff bucket 180 or a conveyor. FIG. 15 shows the completed banded bundle in the machine 170. FIG. 16 shows the banded bundle after it is been picked up by the hoist trolley 174 and is being placed in the bed 190 of a pickup truck. In FIG. 16, a chain 192 rather than nylon strapping is being used to pick the bundle out of the machine 170 and place it in the truck bed 190. FIG. 17 shows the banded bundle being transported to the customers home. It should be noted that the pickup truck 194 is equipped with an overhead boom 196 and a hoist trolley 198, for a typical discussion model. FIG. 18 is an aerial view of the pickup truck 194, with the banded bundle in its bed, backing into the drive way at the customers home. In FIG. 19 the bundle is shown deposited at the customers home at a location convenient to where the fire wood will be burned. In FIG. 19 the cycloidal bundle has been reversed such that its flat upper surface now rest on the ground. In this position the bands can be snipped and the bundle will retain its cycloidal shape. In FIG. 19 a shroud 160 is on the top of the bundle having been placed there to protect the delivery person, provided he considered it necessary, when he sniped the bands that were around the bundle. In the complete process from the loading of the mold shown in FIG. 14 to the deposit of the bundle at the customers home the fire wood sticks were only stacked a single time. This single stacking was when the fire wood sticks were placed in the mold which requires a minimum of special care because the mold confines the fire wood sticks to the optimum shape that has been designed into the mold.

What is claimed is:

1. An apparatus for bundling sticks of firewood comprising:

a base frame;

a horizontally extending open mold mounted on said base frame and having a central portion, said mold adapted to receive firewood sticks transversely therein and confine them to the shape of the mold to form a bundle, the open top of the mold defining a horizontal top of the bundle;

a vertical frame extending upwardly from said base frame;

a generally horizontal boom arm supported by said vertical frame about a vertical axis such that a portion of the generally horizontal boom arm overlies said horizontally extending open top mold;

a first series of chase ways extending laterally along the central portion of said horizontal extending open top mold forming laterally extending open top channels, the laterally extending open top channels are adapted to be closed by an initial layer of firewood sticks, the first series of chase ways adapted to receive lengths of banding material;

a second series of chase ways extending transverse to said first series of chase ways and longitudinally along said horizontally extending open top mold forming open top longitudinally extending channels, the longitudinally extending open top channels are adapted to be closed by an initial layer of firewood sticks that are received in the horizontal extending open top mold, the second series of chase ways adapted to receive lengths of banding material;

a hoist trolley supported on and movable along said generally horizontal boom arm for depositing firewood sticks into said horizontally extending open top mold and picking up and moving bundled bundles of firewood out of said horizontally extending open top mold.

2. The invention as set forth in claim 1, in which the horizontally extending open top mold further includes a vertical side wall against which one end of the transverse firewood sticks are adapted to be stacked such that the corresponding side of the bundle will have a uniform vertical side.

3. The invention as set forth in claim 2, in which the base frame further includes at least one lift member that is confined to vertical movement and adapted to be lifted by said hoist trolley, said lift member including a bundle engaging surface that, prior to raising the lift member, underlies the bundle along a longitudinal edge of the bundle, such that when the lift member is raised by the hoist trolley the lift member raises the longitudinal edge of the bundle tilting it along its longitudinal axis so that bundle lifting straps can be threaded between the horizontally extending open top mold and the bundle.

4. The invention as set forth in claim 3 wherein there are a pair of said lift members, both of which are located along the lower edge of the vertical side wall of the base frame.

5. The invention as set forth in claim 1, in which the base frame further includes at least one lift member that is confined to vertical movement and adapted to be lifted by said hoist trolley, said lift member including a bundle engaging surface that, prior to raising the lift member, underlies the bundle along a longitudinal edge of the bundle, such that when the lift member is raised by the hoist trolley the lift member raises the longitudinal edge of the bundle tilting it along its longitudinal axis so that bundle lifting straps can be threaded between the horizontally extending open top mold and the bundle.

6. The invention as set forth in claim 5 wherein there are a pair of said lift members, both of which are located along the same longitudinal edge of the bundle.

7. The invention as set forth in claim 1, wherein the horizontally extending open top mold has a generally rectangular shaped cross-section having the bottom corners beveled.

8. The invention as set forth in claim 7, in which the base frame further includes at least one lift member that is confined to vertical movement and adapted to be lifted by said hoist trolley, said lift member including a bundle engaging surface that, prior to raising the lift member, underlies the bundle along a longitudinal edge of the bundle, such that when the lift member is raised by the hoist trolley the lift member raises the longitudinal edge of the bundle tilting it along its longitudinal axis so that bundle lifting straps can be threaded between the beveled corners of the horizontally extending open top mold and the bundle.

9. The invention as set forth in claim 1, wherein said apparatus further includes an implement that can be received in the horizontally extending open top mold, said implement functioning in the same manner as the horizontally extending open top mold to form bundles of firewood having a different cross-sectional shape than the horizontally extending open top mold.

10. The invention as set forth in claim 9, wherein the implement has a cycloidal cross-sectional shape extending from one end to the other of the horizontally extending open top.

11. The invention as set forth in claim 1, wherein the horizontally extending open top mold has a cycloidal cross-sectional shape extending from one end to the other of the horizontally extending open top.

12. The invention as set forth in claim 1, wherein the hoist trolley has a downardly extending handle secured thereto that can be grasped by the operator to pivot the generally horizontal boom arm about said vertical axis or pull or push the hoist trolley along the horizontal boom arm.

13. The invention as set forth in claim 1, wherein said apparatus further includes banding material containers adapted to store banding material such that the banding material can be threaded through the chase ways.

14. The invention as set forth in claim 1, wherein said apparatus further includes a jacking plate that is adapted to be placed on the horizontal top surface of the bundle during a banding process to provide a smooth hard surface for a banding tool to react against as well as preventing damage to the bands.

15. The invention as set forth in claim 14, in which the jacking plate includes an edge and handle means on said edge to enable the jacking plate to be pulled out from between tightened bands and the horizontal top surface of the bundle after banding has been completed.

16. The invention as set forth in claim 1, in which the generally horizontal boom arm is comprised of an I-beam having upper and lower rails joined along their longitudinal centers by a vertical flange, the hoist trolley includes bottom support wheels that rest on the lower rail on both sides of the vertical flange, and the hoist trolley also includes upper wheels that engage the I-beam to provide stability to the hoist trolley.

17. The invention as set forth in claim 16, in which a handle is rigidly secured to the hoist trolley and extends downwardly therefrom such that the handle can be grasp by an operator and used to pivot the generally horizontal boom arm about said vertical axis and guide the boom arm as the hoist trolley moves along the horizontal boom arm.

18. The invention as set forth in claim 17, wherein the means supporting the generally horizontal boom arm about a vertical axis on said vertical frame includes a pivot shaft of a given diameter fixed to said vertical frame and extending vertically upwardly therefrom, a housing collar secured to the generally horizontal boom arm having a vertical bore formed therein, said vertical bore having a diameter slightly larger than said given diameter of the pivot shaft such that the pivot shaft is received in the vertical bore, and apertured shims received by the pivot shaft such that a bottom surface of the upper shims rests on the vertical frame and an upper surface of the shims engages the bottom surface of the housing collar.

19. The invention as set forth in claim 17, in which the generally horizontal boom arm extends in both directions from said vertical axis, said hoist trolley is an electric power generator, and there is an electric generator carried by the extent of the generally horizontal boom arm that is opposite to the extent that carries the hoist trolley such that the electric power generator counter balances the hoist trolley and any load being supported by the hoist trolley.

20. The invention as set forth in claim 16, in which the upper wheels of the hoist trolley engage the upper rail of the I-beam.

21. The invention as set forth in claim 20, in which a handle is rigidly secured to the hoist trolley and extends downwardly therefrom such that the handle can be grasp by an operator and used to pivot the generally horizontal boom arm about said vertical axis or pull or push the hoist trolley along the horizontal boom arm.

22. The invention as set forth in claim 16, in which the vertical flange has an upper portion and the upper wheels of the hoist trolley engage the upper portion of the vertical flange.

23. The invention as set forth in claim 22, in which a handle is rigidly secured to the hoist trolley and extends downwardly therefrom such that the handle can be grasp by an operator and used to pivot the generally horizontal boom arm about said vertical axis and pull, push or guide the hoist trolley along the horizontal boom arm.

24. The invention as set forth in claim 16, wherein the means supporting the generally horizontal boom arm about a vertical axis on said vertical frame includes a pivot shaft of a given diameter fixed to said vertical frame and extending vertically upwardly therefrom, a housing collar secured to the generally horizontal boom arm having a vertical bore formed therein, said vertical bore having a diameter slightly larger than said given diameter of the pivot shaft such that the pivot shaft is received in the vertical bore, an apertured shims received by the pivot shaft such that a bottom surface of the upper shims rests on the vertical frame and an upper surface of the shims engages the bottom surface of the housing collar.

25. The invention as set forth in claim 16, in which the generally horizontal boom arm extends in both directions from said vertical axis, said hoist trolley is an electric power generator, and there is an electric generator carried by the extent of the generally horizontal boom arm that is opposite to the extent that carries the hoist trolley such that the electric power generator counter balances the hoist trolley and any load being supported by the hoist trolley.

26. The invention as set forth in claim 1, wherein the means supporting the generally horizontal boom arm about a vertical axis on said vertical frame includes a pivot shaft of a given diameter fixed to said vertical frame and extending vertically upwardly therefrom, a housing collar secured to the generally horizontal boom arm having a vertical bore formed therein, said vertical bore having a diameter slightly larger than said given diameter of the pivot shaft such that the pivot shaft is received in the vertical bore, and apertured shims received by the pivot shaft such that a bottom surface on the vertical frame and an upper surface of the shim engages the bottom surface of the housing collar.

27. The invention as set forth in claim 26, in which the generally horizontal boom arm extends in both directions from said vertical axis, said hoist trolley is an electric power generator, and there is an electric generator carried by the extent of the generally horizontal boom arm that is opposite to the extent that carries the hoist trolley such that the electric power generator counter balances the hoist trolley and any load being supported by the hoist trolley.

28. The invention as set forth in claim 1, in which the generally horizontal boom arm extends in both directions from said vertical axis, said hoist trolley is an electric power generator, and there is an electric generator carried by the extent of the generally horizontal boom arm that is opposite to the extent that carries the hoist trolley such that the electric power generator counter balances the hoist trolley and any load being supported by the hoist trolley.

* * * * *